United States Patent [19]

Jensen et al.

[11] 4,151,657

[45] May 1, 1979

[54] FILM DRYER

[75] Inventors: Gerald A. Jensen, Wayzata; Clare K. Miller, Minneapolis; Ray J. Seiler, Chanhassen, all of Minn.

[73] Assignee: Pako Corporation, Minneapolis, Minn.

[21] Appl. No.: 773,977

[22] Filed: Mar. 3, 1977

[51] Int. Cl.[2] ..... F26B 13/02

[52] U.S. Cl. ..... 34/151; 34/155; 34/157; 34/225; 34/242

[58] Field of Search ..... 312/236, 267; 432/223, 432/64; 34/151, 225, 233, 82, 242, 157, 155; 98/36

[56] References Cited

U.S. PATENT DOCUMENTS

| | | | |
|---|---|---|---|
| 1,564,782 | 12/1925 | Harris | 34/225 |
| 1,589,642 | 6/1926 | Harris | 34/225 |
| 2,376,174 | 5/1945 | Munning et al. | 34/225 |
| 2,495,612 | 1/1950 | Trimble | 34/151 |
| 2,988,819 | 6/1961 | Samson | 34/216 |
| 3,257,739 | 6/1966 | Wentz | 34/225 |
| 3,497,965 | 3/1970 | Cortellessa | 34/242 |
| 3,650,040 | 3/1972 | Statham | 34/82 |
| 3,659,551 | 5/1972 | McKinstry | 98/36 |
| 3,933,595 | 1/1976 | Gordon et al. | 432/64 |

*Primary Examiner*—John J. Camby
*Assistant Examiner*—Larry I. Schwartz
*Attorney, Agent, or Firm*—Kinney, Lange, Westman and Fairbairn

[57] ABSTRACT

A drying chamber wherein photographic film is dried by non-turbulent recirculating conditioned air passing therethrough while the film is suspended from a conveyor system and foreign material is prevented from entering thereinto by an air curtain.

12 Claims, 12 Drawing Figures

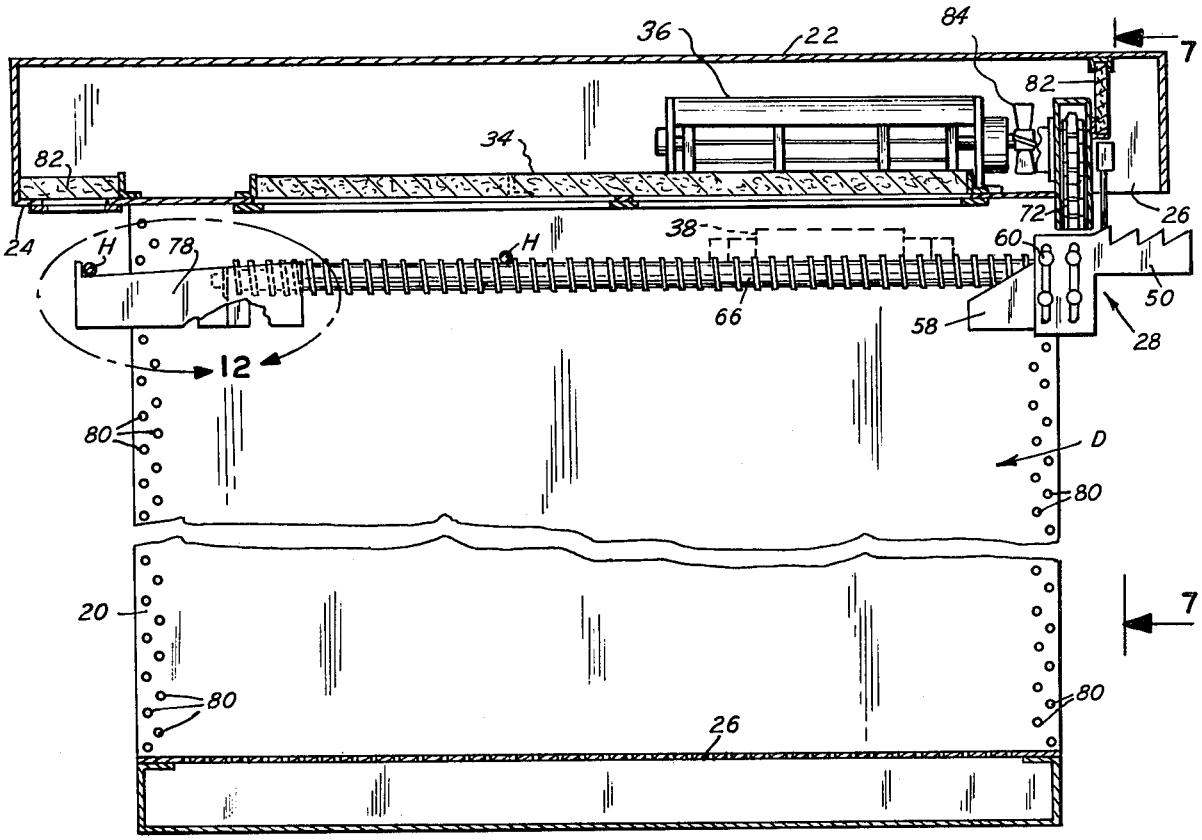
FIG. 4
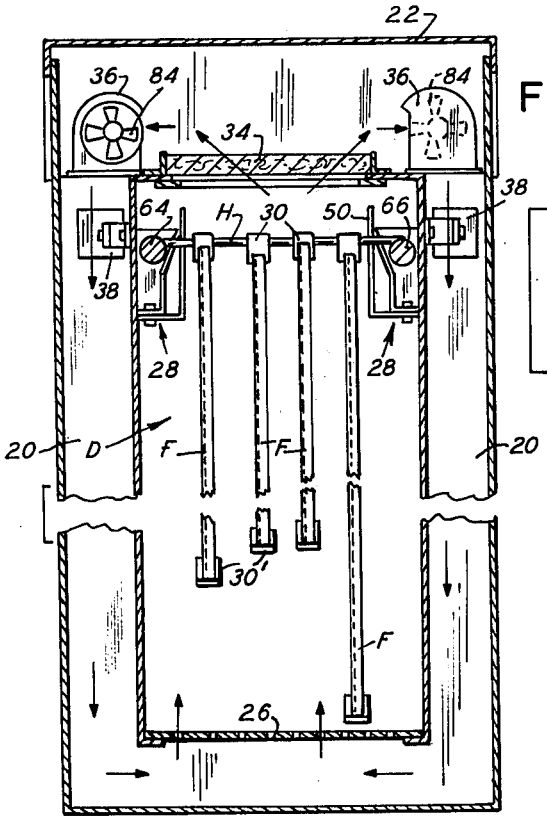
FIG. 5
FIG. 8
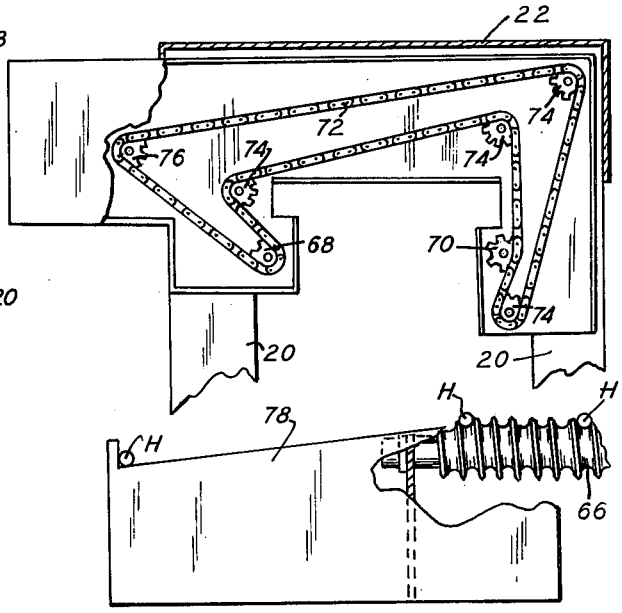
FIG. 12

FILM DRYER

BACKGROUND OF THE INVENTION

Film such as 35mm, 120 and 620 is frequently processed in individual lengths rather than a long continuous web as would result from splicing numerous individual lengths together. For this processing the film lengths are attached to a hanger by film holders such as shown in U.S. Pat. No. 2,803,049. The lower end of the films are weighted with a similar film holder having an additional weight attached. Long films such as 36 exposure 35mm and 620 are looped double to reduce the length and therefore the size of the processing tanks. The lengths of film are processed by sequentially dunking in appropriate chemical solutions, dried and then printed.

In the past, the drying devices have consisted of an array of infrared sources in the sides of the drying chamber, fans to pressurize filtered ambient air, and discharge ports in the side walls to direct the flow of air across the suspended film. Film drying devices of this type have several disadvantages. First, they make no effort to capture and reintroduce the heated air discharged from the chamber and thus require considerable amounts of power to perform the drying function. Second, the side discharge air introduces considerable amounts of turbulance into the drying chamber and often times cause the film to touch and, therefore, stick together thereby destroying the value of the film. Third, the side discharge of the drying air frequently causes non-uniform drying of the suspended film. Fourth, the film drying chambers of the prior art make little attempt to exclude the entry of foreign matter through the open ends of the drying chamber. Thus films frequently are damaged by dust and other airborne foreign material during the drying process.

SUMMARY OF THE INVENTION

The novel features which are characteristic of the present invention overcome these shortcomings as well as offering numerous additional advantages at low initial and operating costs. For example, the floor space required for the drying chamber is reduced and construction simplified by a unique technique of enlarging and reconfiguring the ducts to form the chamber side walls. The drying air is filtered and recirculated to significantly reduce the energy required to operate the drying chamber. Air is discharged through uniformly distributed holes in the bottom of the chamber to insure non-turbulent flow of drying air across the film. Foreign matter is prevented from entering the chamber by air curtains. This feature provides a drying chamber free from particulate contamination without the necessity of opening and closing doors to gain access. Dual fans and heaters are employed to insure uniform flow of heated air through the side wall ducts and into the perforated plenum forming the chamber bottom. A progressive film receiving station is provided external to the chamber to allow excess fluid to drip from the film prior to entering the chamber. The chamber is constructed to provide sufficient height for drying fully extended films of maximum current lengths. The chamber is arranged to provide operator access to the film receiving station so that long lengths of film that have been developed in a doubled manner may be extended to full length prior to drying. Finally, a receiving station is provided at the exit end of the drying chamber to retain dried film while awaiting operator removal.

BRIEF DESCRIPTION OF THE DRAWINGS

FIG. 4 is a vertical sectional view of the film drying chamber taken substantially along viewing line 4—4 of FIG. 2 illustrating the conveyor and blower detail.

FIG. 5 is a vertical sectional view of the film drying chamber taken substantially along viewing line 5—5 of FIG. 1 illustrating the position of the screw conveyors and air flow through the filters, blowers, heaters, ducts and drying chamber.

FIG. 8 is a sectional view 8—8 of FIG. 2 illustrating the method of powering the screw conveyor.

FIG. 12 is an enlarged view taken substantially along viewing line 12—12 of FIG. 4 illustrating the detail of the film hanger receiving station.

DETAILED DESCRIPTION OF THE PREFERRED EMBODIMENT

Figure 1:
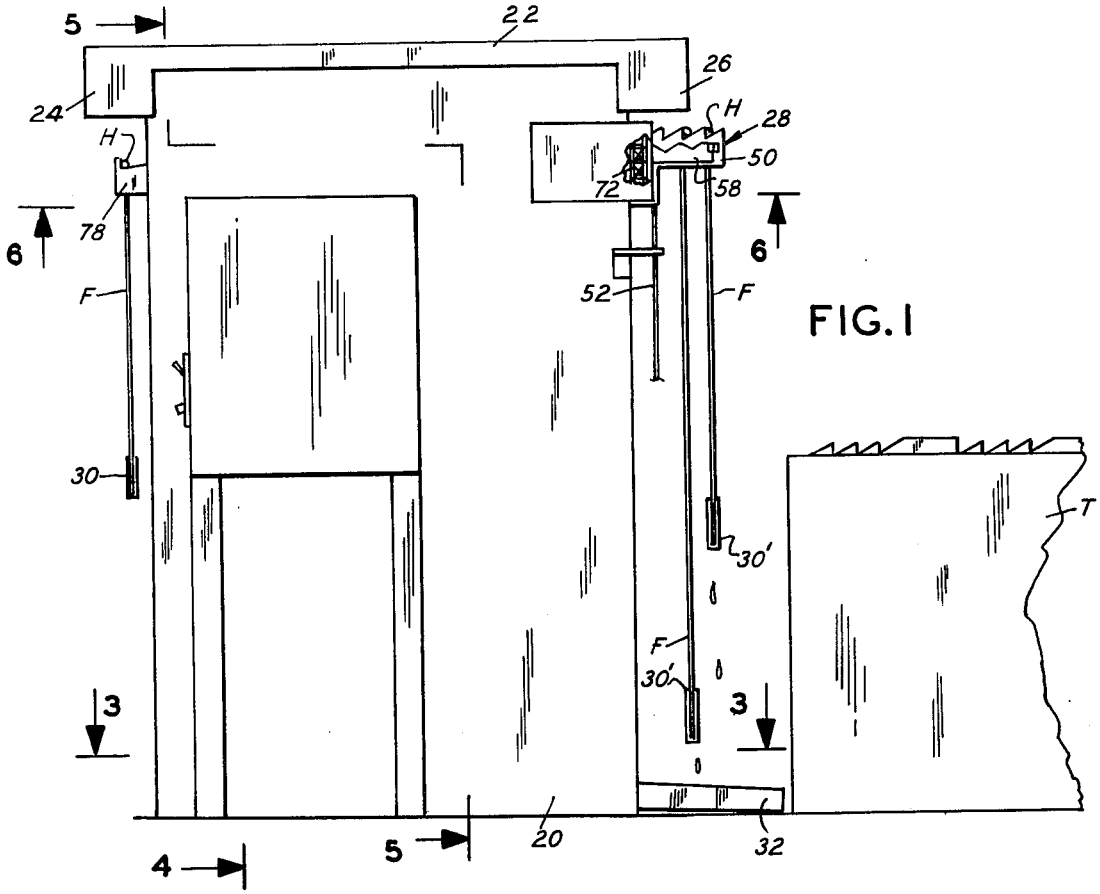
FIG. 1 is an elevational view of the film drying chamber
Figure 2:
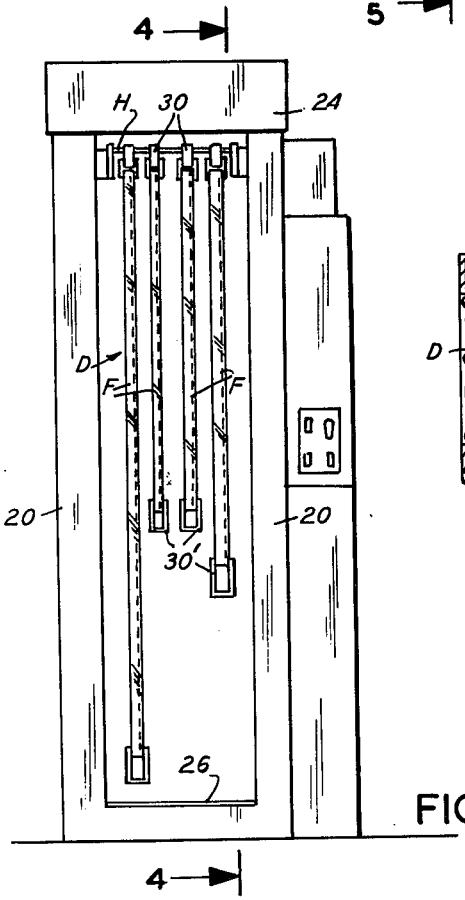
FIG. 2 is an exit and elevational view of the drying chamber illustrating films of various lengths suspended therein.

The film drying chamber illustrated in FIGS. 1 and 2 comprises ducts 20 which form the side walls of the chamber, top 22 with hood projections 24, and bottom 26. A step conveyor assembly is attached to ducts 20 as illustrated in FIG. 1 to receive processed film F from tanks T. The film hanger assembly H with processed film F attached is suspended on the step conveyor assembly 28, which is external to the film drying chamber, where excess processing fluid is allowed to drip from the film into pan 32 thereby relieving a portion of the drying load on the chamber. As illustrated in FIG. 2, processed film F is suspended from film hanger assembly H as by film holders 30 such as shown in U.S. Pat. No. 2,803,049. A second film holder 30' with a weight attached is attached to the lower end of each strip of film to insure that the processed film hangs in an extended manner.

Figure 3:
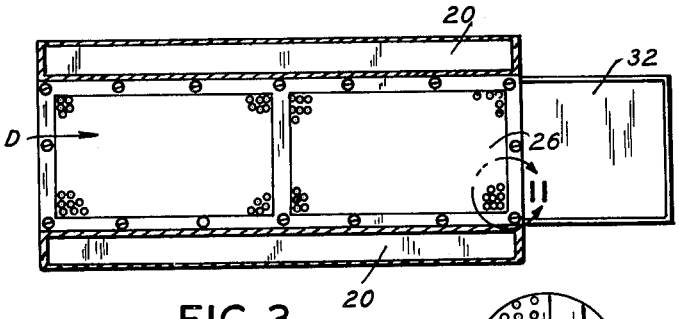
FIG. 3 is a horizontal sectional view of the bottom of the film drying chamber taken substantially along viewing line 3—3 of FIG. 1 illustrating the perforated bottom and ducts forming the sidewalls.
Figure 11:
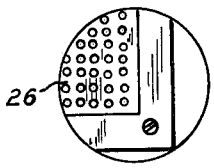
FIG. 11 is an enlarged view taken substantially along viewing line 11—11 of FIG. 3 illustrating the detail of the perforation in the air discharge grille.

Air flow in the chamber is illustrated by arrows in FIG. 5. Chamber air is exhausted into top 22 through air filters 34 thereby removing particulate contamination. Blowers 36, as supplied by Lau Industries Division of Phillips Industries, Inc. Model T2-13.38, pressurize the filtered air and discharge same across finned heaters 38. The heated drying air is directed downward by ducts 20 and discharged into the drying space D through the perforations in bottom 26. FIGS. 3 and 11 show the detail of bottom 26 and more specifically illustrate the uniformly distributed perforations therein.

As illustrated in the figures, blowers 36 are positioned near the entrance end of the drying chamber. The highest concentration of hot drying air, therefore, is at the entrance end. This is advantageous because most of the moisture is removed from the film early in the drying process. We have found that drying in this manner reduces the tendency of the film to curl during drying.

Another important advantage of the drying chamber of the present invention is that the drying air provides "soft" heat to the film. This advantage is achieved by heating and blowing the air at the top of the chamber and conducting the hot air down side wall ducts 20 to the perforations in bottom 26, where the air is exhausted into the drying chamber. We have found that the "soft" heat provided in this manner yields superior results to a "hard" heat system which, for example, heats the air at the top of the chamber and blasts the hot air straight down past the film.

In other words, the dryer of the present invention takes advantage of thermal convection. The heated air is introduced at the bottom gently and rises because it is heated in addition to the push-pull action of the blower. This dryer configuration places the hot-test air at the bottom of the dryer as well as at the entrance. Since the moisture on the film runs down, the dryer of the present invention has the advantage of doubly putting the heat where it is needed.

Processed film F is moved through the drying chamber by a two stage conveyor system comprising step conveyor assembly 28 and a screw conveyor formed by left and right lead screws 64 and 66, respectively. FIGS. 7–10 and 12 show detailed views of the conveyor system.

Figure 9:
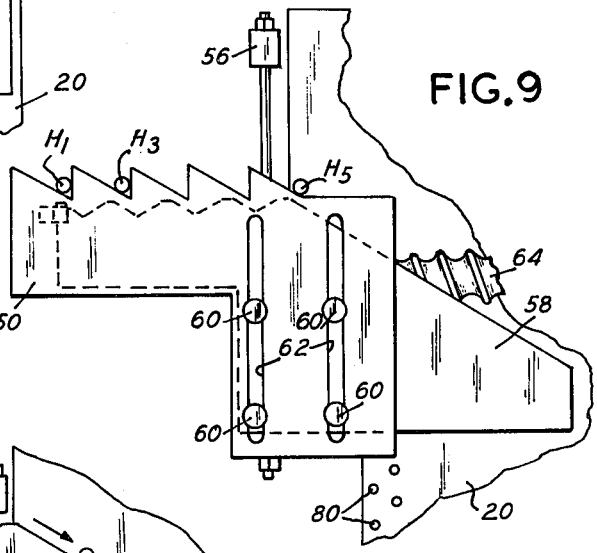
FIG. 9 is a fragmentary sectional view illustrating the detail of the step conveyor assembly with the film carriers engaging the movable member thereof.
Figure 10:
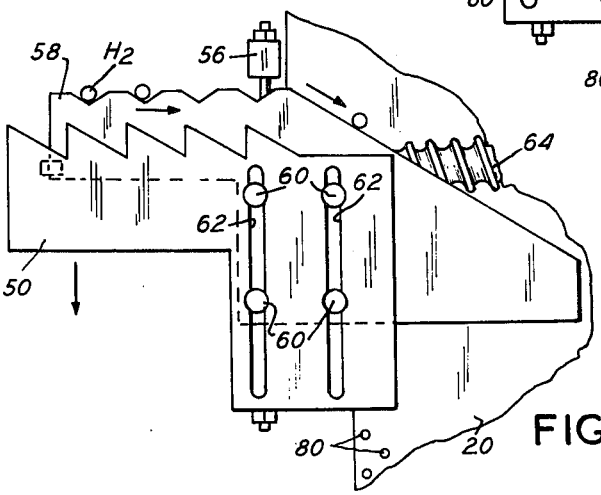
FIG. 10 is a fragmentary sectional view illustrating the detail of the step conveyor assembly with the film carriers engaging the fixed member thereof.

Step conveyor 28 receives processed film from tanks T. Drive means (not shown) attached to linkage 52 provides an oscillatory vertical motion to left movable conveyor plate 50 and right movable conveyor plate 54 which are linked together as by secondary linkage 56 or other suitable means. A pair of fixed conveyor plates 58 are rigidly attached to the inside of duct 20 as best seen in FIGS. 9 and 10. Fixed conveyor plate 58 is configured to provide a series of uniformly spaced symmetrical toothlike projections as illustrated in FIG. 10. Left movable conveyor plate 50 and right movable conveyor plate 54 are configured to provide a series of uniformly spaced sawtooth-like projections as illustrated in FIG. 10. Movable conveyor plates 50 and 54 are attached to fixed conveyor plates 58 as by shoulder screws 60 engaging slots 62 thereby providing capability for the movable conveyor plates 50 and 54 respectively to move in a vertical plane while being maintained in contact with fixed conveyor plates 58.

Figure 6:
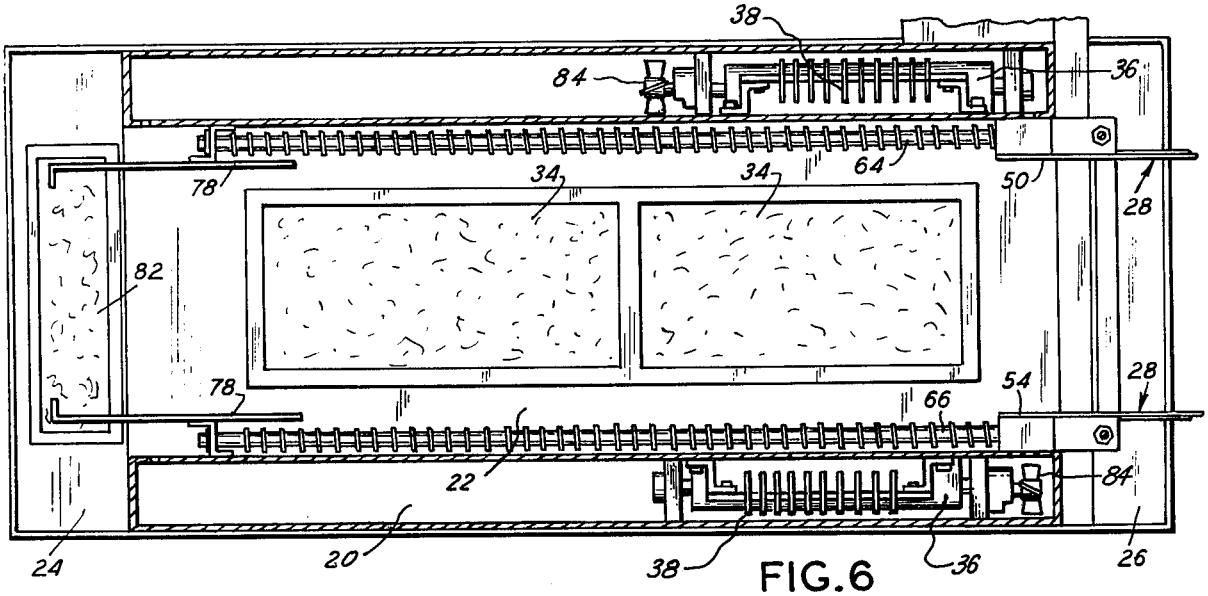
FIG. 6 is a horizontal sectional view taken substantially along viewing line 6—6 of FIG. 1.
Figure 7:
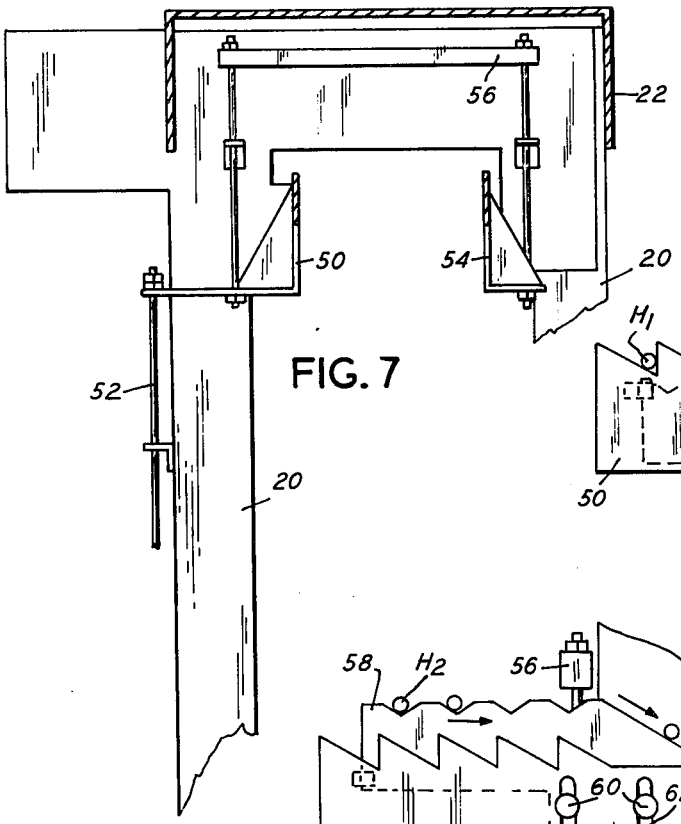
FIG. 7 is a vertical sectional view illustrating the method of powering the step conveyor.

The screw conveyor comprises left lead screw 64 and right lead screw 66 which are rotatably attached to the drying chamber as illustrated in FIGS. 5 and 6. Left lead screw 64 and right lead screw 66 are rotatably powered as by drive sprockets 68 and 70 respectively attached thereto and engaging chain 72 which is trained over a plurality of idler sprockets 74 and a single drive sprocket 76 as best illustrated in FIG. 8. Drive sprocket 76 is powered by a motor or other suitable means not shown.

A dried film receiving station is formed by a pair of brackets 78 attached to ducts 20 and positioned as illustrated in FIGS. 4 and 12 to provide a means of storing dried rilm while awaiting operator removal for subsequent processing.

Transportation of film hanger assembly H by step conveyor assembly 28 is illustrated in FIGS. 9 and 10. A film hanger assembly H is received by the step conveyor assembly 28 in position H1 as illustrated in FIG. 9. Movable conveyor plate 50 is lowered by linkage 52 and secondary linkage 56 respectively. Lowering the movable conveyor plates causes the film hanger assembly H to engage the toothlike projections on fixed conveyor plates 58. The toothlike projections on said fixed conveyor plates are offset with respect to the projections on movable conveyor plate 50, thus causing film hanger assembly H to advance to position H2 as illustrated in FIG. 10. As movable conveyor plate 50 is raised by linkage 52, film hanger assembly H engages the sawtooth projection of fixed conveyor plate 58 and advances to position H3 of FIG. 9. This action continues until the film hanger advances to position H5 of FIG. 9. Lowering of the movable conveyor plate 50 with a film hanger in position H5 causes the film hanger assembly H to engage the fixed conveyor plate 58 and move down the inclined surface thereof and engage lead screw 64 of the screw conveyor assembly. Film hanger assembly H is then transported through the drying space D by the action of lead screws 64 and 66 until the film hanger assemblies H engage receiving station 78. At this time the film hanger assemblies are removed from engagement with said lead screws and retained in the receiving station until removed therefrom by the operator.

A limited amount of air is released from ducts 20 through vent holes 80 which are placed as illustrated in FIG. 4. The conditioned air so vented provides a nonturbulent air curtain to prevent particulate contamination from entering drying space D. The conditioned air is captured by hood projections 24, filtered by air curtain filters 82 and reintroduced into the top by action of fan blade 84 located on blower 36, thus removing particulate contamination from the air curtain discharge prior to reintroduction into the conditioning system.

Because of the make-up air and because of the substantial increase in volume of the air caused by the heat being supplied to the air, the chamber is pressurized. The air curtain is especially effective at the bottom of the entrance and exit openings because it prevents cool external air from near the floor from being introduced in the cabinet. Without the air curtain there will be a negative air pressure at the bottom of the entrance and exit that will allow contamination (e.g. cigarette ashes) to enter the chamber. A normal dryer without air curtains will have an external convection loop that will enter the chamber.

The air curtain at the entrance end is of particular importance because the film which has just entered the chamber and is beginning to dry is very sticky. Any particles which come in contact with the film at that stage will stick to the film and degrade the finished product. The air curtains substantially reduce the likelihood of particulate contamination at this critical stage of the drying process.

It will, of course, be understood that various changes may be made in the form, details, arrangement and proportions without departing from the scope of this invention, which generally stated is set forth in the appended claims.

What is claimed is:

1. A photographic film drying chamber wherein film is suspended in a substantially vertical manner and wherein the drying chamber is defined by substantially vertical side walls with a top, a bottom, and open entrance and exit ends, the drying chamber comprising:

means for providing a substantially vertical flow of drying air within the drying chamber, wherein the means for providing a substantially vertical flow provides a greater concentration of warm drying air in the drying chamber proximate the entrance end than proximate the exit end;

means for preventing foreign matter from entering the drying chamber through the open ends, the means comprising:

a plurality of holes distributed in the side walls in an array adjacent to the open ends to allow a portion of the drying air to flow therefrom thereby forming air curtains which prevent foreign matter from entering the drying chamber;

overhanging collecting hood means extending beyond the drying chamber open ends to collect the air discharged from the plurality of holes distributed in side walls; and conveyor means for transporting the film through the drying chamber.

2. The invention of claim 1 wherein the means for providing a substantially vertical flow of drying air comprises:

air collecting and conditioning means located within the drying chamber;

a plurality of holes distributed across the bottom of said drying chamber; and duct means for interconnecting the air collecting and conditioning means and the plurality of holes.

3. The invention of claim 2 wherein the duct means comprise hollow substantially vertical side walls.

4. The invention of claim 2 wherein the air collecting and conditioning means comprises:

filter means to remove particulate contamination from the air discharged into the drying chamber;

blower means for causing the drying air to be pressurized; and heater means for heating the drying air.

5. The invention of claim 4 wherein the blower means and the heater means are positioned proximate the entrance end of the drying chamber.

6. The invention of claim 5 wherein the blower means and the heater means are positioned at the top of the drying chamber.

7. The invention of claim 1 wherein the overhanging collecting hood means includes filter means to remove particulate contamination from air collected thereby prior to re-introduction of the air into the drying chamber.

8. The invention of claim 1 wherein the substantially vertical flow of drying air is substantially from the bottom upward to the top.

9. A photographic film dryer comprising:

a drying chamber defined by first and second side walls, a top, a bottom, and open entrance and exit ends;

conveyor means for transporting photographic film through the drying chamber while the photographic film is suspended in a substantially vertical manner, means for providing a substantially vertical upward flow of drying air past the photographic film, wherein the means provides a greater concentration of warm drying air proximate the entrance end than proximate the exit end;

means for forming first and second air curtains at the open entrance and exit ends; and means for collecting air from the first and second air curtains for reuse in the drying chamber.

10. The photographic film dryer of claim 9 wherein the means for providing a substantially vertical upward flow of drying air comprises:

air collecting means for collecting air used in the drying chamber;

air conditioning means for conditioning air collected by the air collecting means for use in the drying chamber;

conditioned air discharge means for discharging air from the air conditioning means into the drying chamber; and duct means for interconnecting the air conditioning means and the conditioned air discharge means.

11. The photographic film dryer of claim 10 wherein the air collecting means is positioned proximate the top of the drying chamber and the conditioned air discharge means is positioned proximate the bottom of the drying chamber.

12. The photographic film dryer of claim 11 wherein the conditioned air discharge means comprises a plurality of holes in a bottom plate of the drying chamber.

* * * * *